US011312559B2

(12) United States Patent
Derks

(10) Patent No.: US 11,312,559 B2
(45) Date of Patent: Apr. 26, 2022

(54) PACKAGING TRAY

(71) Applicant: silver plastics GmbH & Co. KG, Troisdorf (DE)

(72) Inventor: Rene Derks, Belfeld (NL)

(73) Assignee: Silver Plastics GmbH & Co, Troisdorf (DE)

( * ) Notice: Subject to any disclaimer, the term of this patent is extended or adjusted under 35 U.S.C. 154(b) by 0 days.

(21) Appl. No.: 16/925,462

(22) Filed: Jul. 10, 2020

(65) Prior Publication Data

US 2021/0269222 A1 Sep. 2, 2021

(30) Foreign Application Priority Data

Feb. 28, 2020 (DE) ..... 102020105364.9

(51) Int. Cl.

| | |
|---|---|
| ***B65D 6/04*** | (2006.01) |
| ***B65D 81/26*** | (2006.01) |
| ***B65D 25/02*** | (2006.01) |
| ***B65D 1/34*** | (2006.01) |

(52) U.S. Cl.

CPC ..... *B65D 81/264* (2013.01); *B65D 1/34* (2013.01); *B65D 25/02* (2013.01)

(58) Field of Classification Search

CPC ..... B65D 1/34; B65D 25/02; B65D 81/264
USPC ..... 206/557, 565, 567, 499, 505, 564
See application file for complete search history.

(56) References Cited

U.S. PATENT DOCUMENTS 3,469,686 A * 9/1969 Gutschehenryw ..... H01L 21/67346 206/712
4,197,940 A * 4/1980 DeRossett ..... A47G 19/26 220/780
5,447,234 A * 9/1995 Faulstick ..... B65D 25/10 206/455
7,946,419 B1 * 5/2011 Stein ..... B65D 25/205 206/459.5
8,006,839 B2 * 8/2011 Hafner ..... A61B 50/30 206/363
8,899,421 B2 * 12/2014 Veltrop ..... A47G 23/04 206/564
2006/0260962 A1 * 11/2006 Dickens ..... A47G 23/08 206/310
2009/0178947 A1 * 7/2009 Nip ..... B65D 21/0212 206/509
2009/0194544 A1 * 8/2009 Vovan ..... A47J 37/01 220/575

(Continued)

FOREIGN PATENT DOCUMENTS

| | | |
|---|---|---|
| DE | 1994362 A1 | 9/1968 |
| DE | 4041461 A1 | 7/1992 |

*Primary Examiner* — Luan K Bui

(74) *Attorney, Agent, or Firm* — Michael R Shevlin

(57) ABSTRACT

The invention relates to a packaging tray composed of plastic with a base (10) and sidewalls (11) which adjoin the base (10) and delimit a receiving space for a product being packaged, and with a baseplate (2) which is placed onto the upper side of the base (10) and forms a supporting surface for the product being packaged, wherein the baseplate (2) and the base (10) are formed with at least one releasable connecting means for releasably fixing the baseplate (2) to the base (10) of the packaging tray (1), wherein the connecting means are complementary with respect to one another and are formed integrally in the base (10) and in the baseplate (2).

8 Claims, 2 Drawing Sheets

(56) References Cited

U.S. PATENT DOCUMENTS

| | | | | |
|---|---|---|---|---|
| 2009/0200195 | A1* | 8/2009 | Kovacevich | B65D 43/0218 206/561 |
| 2015/0280180 | A1* | 10/2015 | Ok | H01M 50/213 429/99 |
| 2018/0273232 | A1* | 9/2018 | Wallace | B65D 81/265 |
| 2019/0044109 | A1* | 2/2019 | Sugimoto | B65D 5/503 |

* cited by examiner

PACKAGING TRAY

The invention relates to a packaging tray composed of plastic with a base and sidewalls which adjoin the base and delimit a receiving space for a product being packaged, and with a baseplate which is placed onto the upper side of the base and forms a supporting surface for the product being packaged.

A variety of packaging trays of the type mentioned at the beginning are known in particular for packaging liquid-dispensing foodstuffs, for example meat. The packaging trays ensure a sufficient capacity for absorbing the liquid leaking out of the packaged foodstuff, in particular meat juice or blood, since the liquid is otherwise assessed as being unsightly by the consumer.

In addition to packaging trays having soak pads, for example, on the basis of cellulose and packaging trays made of absorbent, foamed plastic, embodiments are also known in which depressions are provided over a large area in the base region and are covered by a film plate having holes acting in a capillary-like manner, for which purpose reference is made by way of example to DE 1 994 362 A1.

DE 40 41 461 A 1 likewise discloses a packaging tray in which a cavity is formed in the base region in order to receive liquid, said cavity being covered by a baseplate which is placed onto the base and forms the supporting surface for the product being packaged.

However, a disadvantage of the previously known packaging trays with baseplates placed on the base side is the non-captive connection between baseplate and packaging tray that very easily leads to the baseplate with the product being packaged located thereon undesirably shifting within the packaging tray and, further, the manufacturing and preparation of packaging trays of this type has proven highly complicated.

By contrast, packaging trays composed of absorbent foam have been recently critically questioned for environmental and sustainability reasons, and therefore there is a need for suitable substitutes which are distinguished by easy handling and good recyclability and high absorbency.

In order to achieve this object, according to the invention the embodiment of a packaging tray with the features of patent claim 1 is proposed.

Advantageous embodiments and developments of the invention are the subject matter of the dependent claims.

The proposal according to the invention makes provision for the baseplate and the base to be formed with at least one releasable connecting means for releasably fixing the baseplate to the base of the packaging tray, wherein the connecting means are complementary to one another and are formed integrally in the base and in the baseplate.

This embodiment according to the invention makes it possible for the packaging tray itself and the baseplate, which is provided for introduction into the packaging tray, to already be equipped during their production, customarily by thermoforming from suitable premanufactured films, with connecting means formed in a complementary manner with respect to one another, and therefore said connecting means can subsequently be connected to one another in the designated use position prior to the filling with the previously packed product, as a result of which the positional accuracy and the subsequent handling are significantly improved since there is no longer any risk of the baseplate moving out of the desired positioning within the packaging tray. Furthermore, owing to the integral formation of the connecting means provided, additional fixing aids, such as weld seams or adhesive points, which would be associated with a further outlay, can be dispensed with.

According to one proposal of the invention, the at least one connecting means is formed by a latching projection and a latching recess corresponding thereto, which latching projection and latching recess can be formed integrally in the packaging tray and the baseplate during the production thereof, for example by thermoforming, without a large outlay.

According to one embodiment of the invention, the base is formed with at least one upwardly projecting latching projection and the baseplate is accordingly formed with a corresponding number of associated latching recesses on its lower side facing the base.

According to a further proposal of the invention, just one single connecting means is arranged centrally in the base and baseplate, wherein the upper side of the baseplate is advantageously flat in the region of said connecting means in order to form a smooth engagement surface, for example, for a suction gripper which, in an automated manner, picks up the premanufactured baseplate and introduces it into a provided packaging tray and brings the connecting means into engagement with one another.

However, it goes without saying that also more than one such connecting means may be provided between base and baseplate.

In order to receive a sufficient quantity of liquid leaking out of the product being packaged, according to a further proposal of the invention the baseplate, starting from its upper side, can have a multiplicity of cup-shaped depressions which form liquid reservoirs and are molded into the surface, wherein the opening cross sections, lying in the supporting surface for the product being packaged, of the depressions are preferably dimensioned in such a manner that they can receive liquids in a capillary-like manner. According to the invention, receiving the liquid in a capillary-like manner is understood as meaning that the liquid is drawn into the depression because of the capillary forces and surface tension and is retained there. For example, the opening width can be a maximum of 3 mm in an axial direction, and therefore liquids which arise are drawn automatically into the depression because of the capillary action and are reliably retained there. The baseplate itself, like the packaging tray, therefore does not need to be produced from an absorbent plastic.

The packaging tray according to the invention can be produced from a multiplicity of plastics and suitable combinations thereof, for example from polyethylene terephthalate (PET) and/or polyethylene (PE). Also, for example, the packaging tray can be produced from a plastic different from the base, for example the packaging tray can be produced from PET and the base from PE.

In particular, the invention affords the possibility of producing the packaging tray and the baseplate from an identical type of compact, i.e. unfoamed, plastic, with polypropylene (PP) or polyethylene terephthalate (PET) particularly being regarded as suitable.

According to a further proposal of the invention, the base of the packaging tray according to the invention in order to increase its stability can be formed with ribbings protruding on the upper side and/or lower side, wherein depressions in the baseplate that lie opposite the ribbings protruding on the upper side have a correspondingly smaller depth than the adjacent depressions. It is thereby ensured that the baseplate can be oriented parallel to the base and, in a use position in which the at least one connecting means also causes the baseplate to be fixed to the base, the baseplate is supported virtually over the entire area on the base by the depressions. If ribbings protruding on the lower side are provided in the packaging tray, the opposite depressions in the baseplate can also have a correspondingly greater depth than the adjacent depressions.

Since, furthermore, packaging trays of this type after being filled with the product being packaged are frequently sealed on the upper side by a stretch film or—in the case of what are referred to as modified atmosphere packaging (MAP) trays—by a sealing film, it is proposed to form the upper end of the sidewalls facing away from the base in a rounded manner, preferably approximately semicircularly in cross section, such that a smooth edge is formed which, even when the packaging tray is produced from compact, unfoamed plastic, does not have any sharp edges at which the stretch film or sealing film placed thereon could be damaged.

As a result of the type-specific production, which is possible within the scope of the invention, of the packaging tray and the baseplate from a corresponding plastic and the connecting means ensuring releasable fixing, it is furthermore possible to separate the packaging tray from the baseplate after use and to supply it for recycling, and it is also possible to directly recycle the type-specific packaging trays together with the baseplates fastened thereto.

Further details and embodiments of the invention will be explained below with reference to the drawing which illustrates an exemplary embodiment and in which.

A packaging tray 1 for packaging, for example, foodstuffs, such as meat, can be seen in FIGS. 1 to 4. It is desirable for such packaging trays to be capable of receiving and retaining liquid, for example meat juice and blood, leaking out of the product being packaged.

Figure 1:
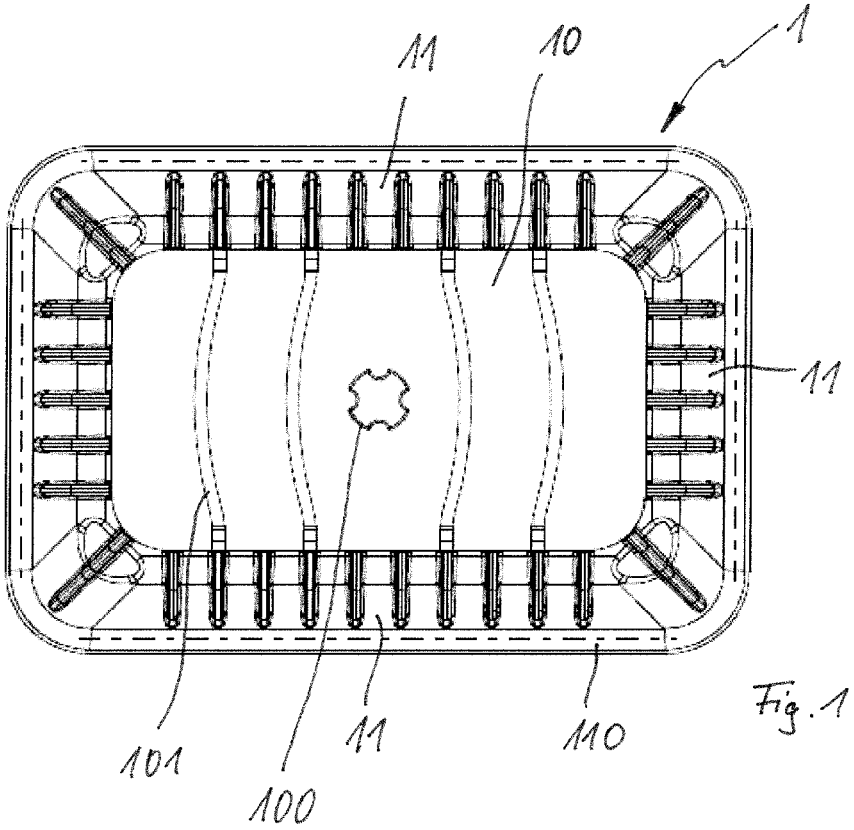
FIG. 1 shows the top view of a packaging tray according to the invention.

According to the illustration in FIG. 1, the packaging tray 1 has a construction which is known per se with a base 10 and sidewalls 11 which are adjacent to the base 10, extend upward and together bound a receiving space for receiving the product being packaged.

The upper edge of the sidewalls 11 that is remote from the base 10 is formed peripherally into a smooth edge 110 which is bent over approximately semicircularly as viewed in cross section, such that a stretch film or sealing film (not illustrated) for closing the receiving space together with the product being packaged positioned therein can be placed on and optionally bonded along the edge 110.

The packaging tray according to FIG. 1 is produced from a compact, unfoamed sheet, for example from polypropylene, by thermoforming and, in order to increase its dimensional stability, has a plurality of reinforcing ribs 101, here a total of four, which are formed upward in the base 10.

Centrally in the base 10, furthermore, a latching projection 100 which is approximately X-shaped in top view and protrudes upward is molded integrally into the base 10.

Figure 2:
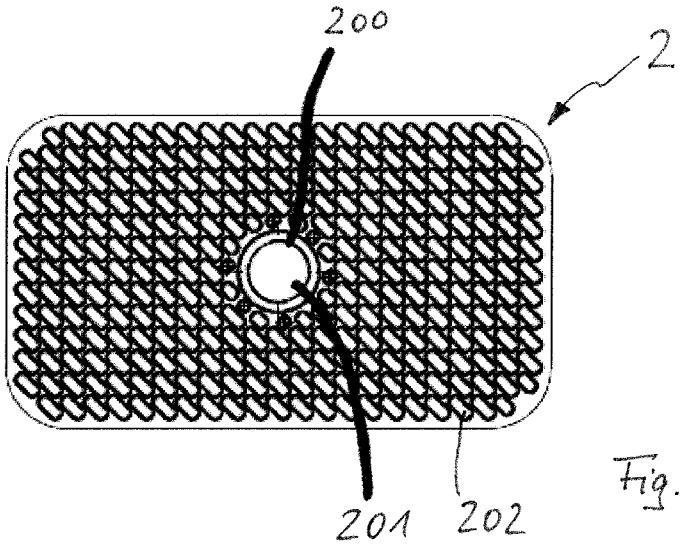
FIG. 2 shows the top view of a baseplate according to the invention.

Corresponding to said packaging tray which can be seen in FIG. 1, a baseplate 2 according to FIG. 2 is provided, said baseplate being dimensioned in such a manner that it completely covers the base 10 of the packaging tray 1, i.e. corresponds in surface extent approximately to that of the base 10 of the packaging tray 1.

The baseplate 2 is also produced from the same compact, unfoamed sheet material as the packaging tray 1; in the exemplary embodiment illustrated, to this extent likewise from polypropylene by thermoforming of a corresponding sheet.

Figure 3:
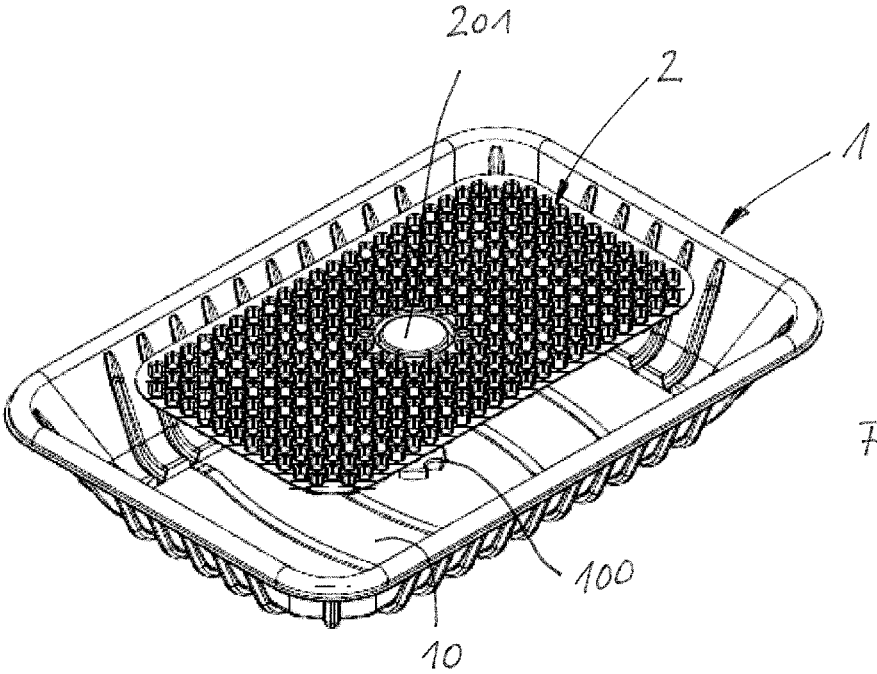
FIG. 3 shows, in a perspective illustration, the introducing of the baseplate according to FIG. 2 into the packaging tray according to FIG. 1.
Figure 4:
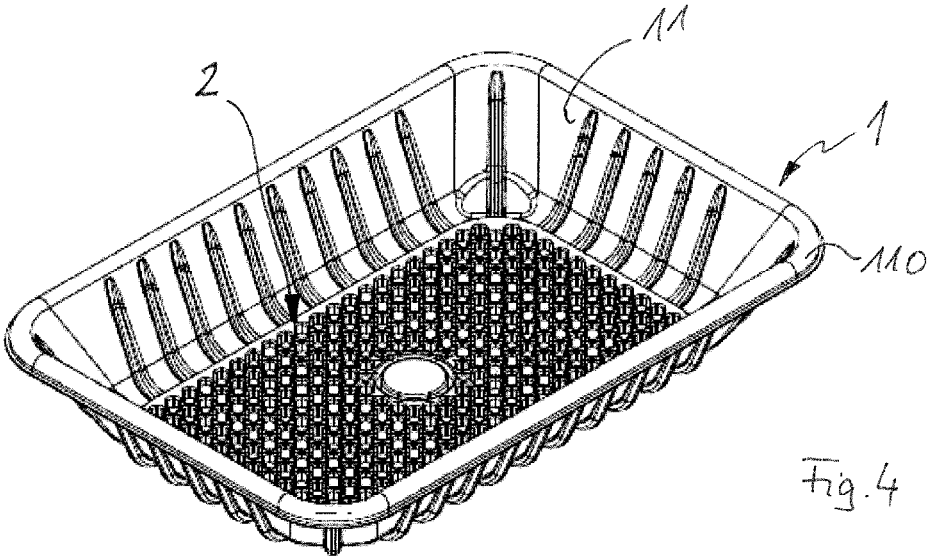
FIG. 4 shows the packaging tray according to the invention in the use state.

Corresponding to the arrangement of the latching projection 100 in the region of the base 10 of the packaging tray 1, the baseplate 2 also has, in its central region, a latching depression 200 which is formed in a complementary manner with respect to the latching projection 100, extends upward from the lower side of the baseplate 2 and, on the upper side of the baseplate 2, forms a circular, flat surface 201. Said flat surface 201 can be grasped, for example, by an automated suction gripper, and therefore it is possible, as illustrated in FIG. 3, to place the baseplate 2 into the packaging tray 1. The baseplate 2 here completely covers the base 10 of the packaging tray and forms the supporting surface for the product being packaged. At the same time, the latching projection 100 and the complementarily formed latching depression 200 enter into a releasable latching connection such that, in the use state illustrated according to FIG. 4, the baseplate 2 is positioned and fixed in a precise position in the packaging tray 1 and can no longer shift undesirably. Equally, it is possible, by applying a sufficiently large tensile force, also to detach the baseplate 2 again from the packaging tray 1.

Furthermore, in order to receive the liquid leaking out of the product being packaged, the baseplate 2 is provided with a multiplicity of substantially correspondingly large cup-shaped depressions 202 which are arranged in the manner of a grid and extend in the opposite direction to the latching depression 200, i.e. run from an upper-side opening in the direction of the lower side of the baseplate 2 where they are closed, however, by a corresponding base region and to this extent form liquid reservoirs for liquid to be received.

The opening width, or the opening cross section, of the individual depressions 202 that lies in the supporting surface for the product being packaged is dimensioned here in such a manner that each individual depression 202 can receive the liquids arising from the product being packaged in a capillary-like manner, i.e. using the capillary forces, and can retain said liquids within the depression. In the case of the approximately lenticular configuration of the opening cross section that is illustrated, this can be achieved, for example, by the smallest diameter being approximately at maximum 3 mm; however, this can be determined as desired by a person skilled in the art.

The depth of the cup-shaped depressions 202 is substantially identical, but those depressions 202 which come to lie above the upwardly protruding reinforcing ribs 101 of the base 10 of the packaging tray 1 are formed with a correspondingly smaller depth, and therefore a flat position of the baseplate 2 on the base 10 of the packaging tray 1 can be achieved and the baseplate 2 is supported with the respective base regions of the depressions 202 on the base 10 of the packaging tray 1 including the protruding reinforcing ribs 101.

The packaging tray 1 that is illustrated above and has an inserted and fixed baseplate 2 provides great capability for receiving liquids and, furthermore, owing to the type-specific production from unfoamed plastics, provides the possibility of particularly easy recyclability along with high safety during use.

The invention claimed is:

1. A packaging tray composed of plastic with a base (10) and sidewalls (11) which adjoin the base (10) and delimit a receiving space for a product being packaged, and with a baseplate (2) having a multiplicity of cup-shaped depressions (202) forming liquid reservoirs which is placed onto the upper side of the base (10) and forms a supporting surface for the product being packaged, wherein the base (10) is formed with ribbings (101) protruding on the upper side and/or lower side, and the depressions (202) in the baseplate (2) that lie opposite the ribbings (101) protruding on the upper side have a correspondingly smaller depth than the adjacent depressions (202) in such a manner that the baseplate (2) can be oriented and can be fixed parallel to the base (10) and is supported on the base (2) by the depressions (202), wherein the baseplate (2) and the base (10) are formed with at least one releasable connecting means for releasably fixing the baseplate (2) to the base (10) of the packaging tray (1), wherein the connecting means are complementary with respect to one another and are formed integrally in the base (10) and in the baseplate (2).

2. The packaging tray as claimed in claim 1, wherein the at least one connecting means comprises a latching projection (100) and a latching recess (200) corresponding thereto.

3. The packaging tray as claimed in claim 2, wherein the base (10) is formed with at least one upwardly projecting latching projection (100) and the baseplate (2) is formed with corresponding latching recesses (200) on its lower side facing the base (10).

4. The packaging tray as claimed in claim 1, wherein the connecting means is arranged centrally in the base (10) and baseplate (2), wherein the upper side of the baseplate (2) is flat in the region of the connecting means.

5. The packaging tray as claimed in claim 1, wherein the opening cross sections of the depressions (202) are dimensioned in such a manner that they receive liquids in a capillary-like manner.

6. The packaging tray as claimed in claim 1, wherein the upper end of the sidewalls (11) facing away from the base is formed peripherally into a rounded edge (110).

7. The packaging tray as claimed in claim 1, wherein the packaging tray (1) and the baseplate (2) are produced from an identical type of compact, unfoamed plastic.

8. The packaging tray as claimed in one of claim 7, wherein polypropylene, polyethylene and/or polyethylene terephthalate is provided as the plastic.

* * * * *